United States Patent [19]

Pfaff

[11] 4,047,952

[45] Sept. 13, 1977

[54] IMAGEWISE SOLUBLE SILVER SALT INTENSIFICATION OF DIFFUSION TRANSFER SILVER IMAGES

[75] Inventor: Maurice Edgar Pfaff, Le Perreux, France

[73] Assignee: Eastman Kodak Company, Rochester, N.Y.

[21] Appl. No.: 680,932

[22] Filed: Apr. 28, 1976

[30] Foreign Application Priority Data

May 2, 1975 France ..... 75.13773

[51] Int. Cl.[2] ..... G03C 5/54; G03C 7/00; G03C 1/48; G03C 1/40

[52] U.S. Cl. ..... 96/29 R; 96/3; 96/29 D; 96/73; 96/74; 96/76 R; 96/76 C; 96/77

[58] Field of Search ..... 96/29 R, 76 R, 29 D, 96/3, 77, 60 R, 48 PD, 76 C, 73, 74

[56] References Cited

U.S. PATENT DOCUMENTS

| | | | |
|---|---|---|---|
| 3,630,730 | 12/1971 | Stewart et al. | 96/29 D |
| 3,630,731 | 12/1971 | Schwan et al. | 96/29 D |
| 3,647,436 | 3/1972 | Bush | 96/29 D |
| 3,647,439 | 3/1972 | Bass | 96/29 R |

FOREIGN PATENT DOCUMENTS

| | | | |
|---|---|---|---|
| 904,364 | 8/1962 | United Kingdom | 96/29 D |

*Primary Examiner*—David Klein
*Assistant Examiner*—Richard L. Schilling
*Attorney, Agent, or Firm*—R. P. Hilst

[57] ABSTRACT

The use of a soluble, reducible silver salt in combination with an imagewise exposed diffusion transfer photographic element comprising a negative silver halide emulsion and an associated physical development nuclei layer provides a resultant photographic image having intensified maximum density areas with little or no effect on minimum density areas.

24 Claims, 1 Drawing Figure

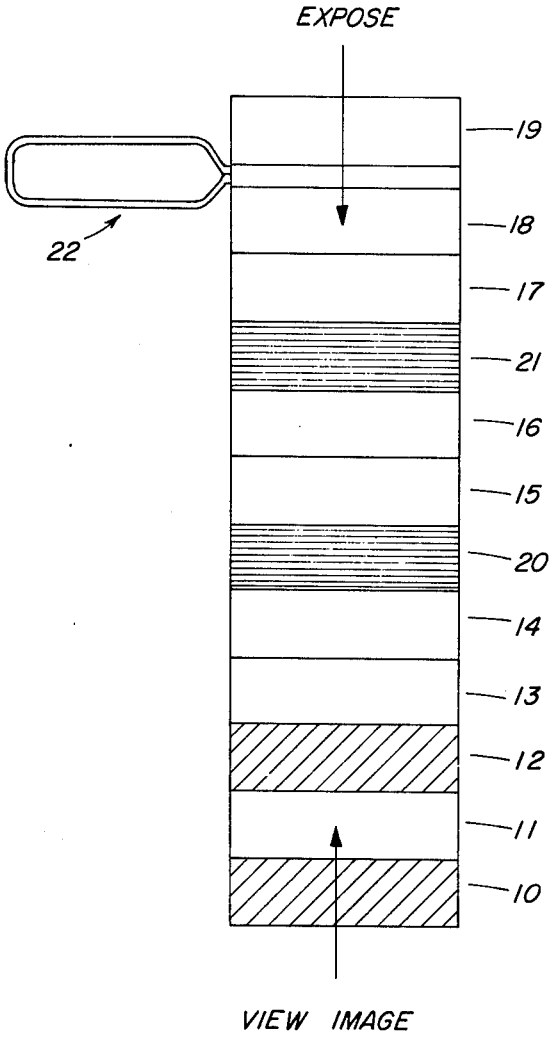
EXPOSE
19
18
17
21
16
15
20
14
13
12
11
10
22
VIEW IMAGE

IMAGEWISE SOLUBLE SILVER SALT INTENSIFICATION OF DIFFUSION TRANSFER SILVER IMAGES

FIELD OF THE INVENTION

The present invention relates to a process and a photographic element for obtaining photographic images by diffusion transfer. More particularly, the present invention relates to a process and a photographic element for obtaining photographic images by the diffusion and the transfer of a soluble silver complex onto a layer where physical development of such silver complex is carried out, with or without subsequent formation of a second image such as a dye image.

BACKGROUND OF THE INVENTION

Diffusion transfer processes which employ the formation of a soluble silver complex and the reduction of this complex in the presence of physical development nuclei are well known, as is the application of these processes to obtain either a positive, metallic silver photographic image or, in the case where the physical development is also associated with a dye forming substance, a positive color photographic image. See British Pat. No. 904,364, page 19, lines 1–41.

In many such processes, it is desirable to obtain physical development yielding a silver image the density of which is as high as possible. For this purpose, various intensifying means have been proposed in the prior art; in particular, organic substances have been used such as heterocyclic mercaptans which make it possible, due to their ability to react with the developed silver, to intensify the black appearance of silver images.

OBJECTS OF THE INVENTION

The present invention has for one of its objects a diffusion transfer photographic process, and a photographic element embodying the process, which employs the physical development of a soluble silver-containing complex image into a silver image and the intensification of this silver image.

The present invention has as a further object the application of this process to provide a system of color photography by diffusion and transfer of dyes.

SUMMARY OF THE INVENTION

The process according to the invention comprises (1) exposing an element comprising at least one silver halide negative emulsion layer and an associated physical development layer containing physical development nuclei and (2) developing the emulsion layer with a chemical developer in the presence of a silver halide solvent and an alkaline activator which contains a soluble, reducible silver salt, said solvent and activator being applied on one side of the exposed negative emulsion layer while simultaneously the other side of this emulsion layer is being contacted with the physical development layer. Generally, the solvent and the alkaline activator are together in a single solution, sometimes referred to hereinafter as a processing composition or solvent activator.

As described above, a photographic element in accordance with the present invention has a structure characterized by an arrangement of photograpic layers positioned in a precise sequence. In the photographic element of the invention it is essential that the negative emulsion layer be between the solvent activator and the physical development layer so that during processing the solvent activator passes through the negative emulsion layer before reaching the physical development layer.

The process and the photographic element of the invention provide several advantageous effects which are more fully described hereinafter. One particularly surprising and advantageous feature of the invention is the finding that in the presence of the soluble, reducible silver salt one obtains an intensification of the photographic image formed in the physical development layer and such image intensification occurs only in maximum image density areas with little or no accompanying increase in minimum large density areas.

BRIEF DESCRIPTION OF THE DRAWINGS

The figure is a diagrammatic cross-sectional view of a preferred color photographic film element of the invention illustrating preferred configuration of the various components comprising such an element.

DESCRIPTION OF THE PREFERRED EMBODIMENTS

During step (1) of the invention as described above a latent image is formed in the negative emulsion layer; in step (2) this latent image is developed in the presence of the silver halide solvent and the alkaline activator, by a chemical developing agent associated with the negative emulsion layer, for example, by incorporation of the chemical developer in the emulsion layer or an adjacent interlayer or by incorporation of the chemical developing agent in admixture with the silver halide solvent or the alkaline activator. Simultaneously, during step (2) the silver halide solvent and the alkaline activator perform two other functions:

a. the silver halide solvent complexes the undeveloped silver halide of the negative emulsion layer and the complex thus formed, which is soluble in the alkaline processing composition, diffuses toward the adjacent physical development layer where, by physical development, a positive silver image is obtained (this is the conventional function of such a silver halide solvent);

b. the soluble, reducible silver salt contained in the alkaline activator produces an increase in density of the positive silver image of the physical development layer, but, unexpectedly, such increase in density occurs only in areas having maximum silver density. The areas of the physical development layer exhibiting minimum silver density, which correspond to the exposed areas of the adjacent negative emulsion layer, are not modified. In principle, one would expect the soluble, reducible silver salt contained in the alkaline activator to pass through the adjacent negative emulsion layer and to uniformly transfer into the physical development layer where it would be reduced. Accordingly, one would expect to see a uniform increase or intensification of the density in the physical development layer.

However, in the process of the present invention, the diffusion of the soluble silver salt contained in the alkaline activator is modulated by the silver image formed in the negative silver halide emulsion layer. A possible theoretical explanation of this modulation phenomenon can be given as follows (of course, this explanation is in no way intended to limit the scope of the present invention): The silver development in the negative emulsion layer is very rapid and this developed silver is in such a physical state, in particular as far as its specific surface is concerned, that it can advantageously perform the function of physical development nuclei or agent. Accordingly, the soluble, reducible silver salt of the processing composition is reduced in the presence of this freshly developed silver image which acts as physical development nuclei. It is this capability of the developed negative silver image formed in the negative layer, i.e., the capability of this silver image to perform the function of physical development agent, which is believed to improve the positive transfer silver image formed in the physical development layer adjacent the negative emulsion layer. Thus, in the areas where the negative emulsion is developed, the soluble, reducible silver salt introduced in the solvent activator will be reduced and therefore will not be able to go through the negative emulsion layer to reach the underlying physical development layer. On the other hand, in the areas where the negative emulsion has not been developed, there does not exist any barrier to the diffusion of the reducible silver salt; consequently, this silver salt diffuses simultaneously with the activator to the physical development layer where it thus formed an intensified positive silver image, in proportion to the amount of soluble, reducible silver salt reducing the physical development layer.

The physical development of the solubilized silver halide which diffuses into the physical development layer in the process of the present invention takes place as a result of its contact with the physical development nuclei contained in this layer. These nuclei act as sites for the reduction of the silver halide to metallic silver in the presence of the alkaline processing composition and a chemical developing agent. The chemical developing agent associated with the physical development layer may be incorporated in the silver halide emulsion layer, the physical development layer, or an adjacent interlayer, e.g., a gelatin interlayer, or it may be admixed with the silver halide solvent in the alkaline activator and diffuse into the physical development layer through the adjacent negative emulsion layer. Depending upon the particular negative silver halide emulsion, the particular physical development nuclei, and the associated dye forming materials, if any, which are employed in the present invention, the chemical developing agent associated with the physical development layer may be the same or different from the chemical developing agent associated with the negative emulsion layer.

The present invention can be applied to various known systems of diffusion transfer photography. In accord with one embodiment of the invention, useful in black-and-white photography, one can employ an element which comprises, on a support, successively, a physical development layer with associated chemical developing agent, a negative silver halide photosensitive emulsion layer with associated chemical developing agent, and means for applying the silver halide solvent and alkaline activator containing the soluble, reducible silver salt, to the side of such emulsion layer which is opposite the support. After processing, one can, if desired, separate the emulsion layer from the physical development layer, for example, by washing, leaving only the support bearing a layer containing the positive silver image.

The reducible silver salt which is incorporated in the processing composition, or in the alkaline activator if the latter is used independently of the solvent, may be any silver salt soluble in an alkaline solution and capable either of (a) forming, in the presence of a solvent, a complex reducible in the presence of physical development nuclei, or (b) being itself reducible in the presence of physical development nuclei. Among the examples of silver salts thus usable, silver nitrate, silver acetate, silver perchlorate, etc. may be cited. The term "physical development nuclei" includes without discrimination the substances used commonly in the art in that capacity such as colloidal metals, e.g., colloidal silver, colloidal gold, etc., colloidal metal sulfides, e.g., colloidal silver sulfide, colloidal zinc sulfide, etc., as well as the freshly developed silver image obtained in the negative emulsions according to the present invention.

The amount of the soluble, reducible silver salt used in the present invention will vary depending on such factors as the particular silver halide emulsion used, the composition of the alkaline activator which will be used as a solvent for the reducible silver salt, and the like. Thus, in any given photograpic element of the invention the optimum amount of reducible silver salt will depend on the particular composition of the various materials in the element. Accordingly, the optimum amount of reducible silver salt can most advantageously be determined by those of ordinary skill in the art merely by carrying out a routine concentration series wherein a series of alkaline activator compositions are prepared, each containing a different amount of the particular reducible silver salt to be used. In general, it has been found that useful results are obtained when the amount of reducible silver salt is within the range of from about 0.5 to about 20 weight percent of the alkaline activator, depending upon the solubility of the elected silver salt when complexed in the activator.

Among the silver halide solvents (or silver halide complexing agents as these materials are sometimes referred to in the art) useful in the present invention, are any of those well known in the art including inorganic solvents for silver halide, such as alkali metal and ammonium thiosulfates and thiocyanates, e.g. sodium thiosulfate, and organic complexing agents for silver halide, such as bis(alkylsulfonyl)methanes, e.g. bis-(methylsulfonyl)methane.

It has been found, surprisingly, that activators containing a soluble, reducible silver salt and a silver halide solvent or complexing agent in an alkaline medium exhibit a very satisfactory stability. Thus, a mixture of bis-(methylsulfonyl)methane and silver nitrate remains stable at pH $\geqq$ 12.

According to a further advantageous embodiment, the present invention can be employed in diffusion transfer color photography. Many photographic elements and processes have been already described in the field of diffusion transfer color photography. The present invention is applicable to any such diffusion transfer color photographic process which employs a silver halide solvent and an alkline activator passing first through an exposed negative emulsion layer and then into contact with an adjacent physical development layer having an associated dye forming substance. In such a diffusion transfer color photographic process one obtains the formation of a soluble silver complex in the unexposed regions of the negative silver halide emulsion layer and the physical development of this complex in the adjacent physical development layer which, in turn, initiates the formation of a dye image from the dye forming substance associated with the physical development layer.

Typically, a photograpic element for diffusion transfer color photography successively comprises a first transparent support, a dye image receiving layer, e.g. a layer of polymeric mordant, a reflecting layer, at least one element comprising (1) a physical development layer of physical development nuclei associated with a dye image forming substance and (2) a silver halide negative emulsion layer, means for applying the silver halide solvent and alkaline activator, and, finally, a second transparent support. Of course, as explained hereinabove in connection with the black and white photographic embodiments of the invention, a diffusion transfer color photographic element of the invention also contains one or more developers associated with the negative emulsion layer(s) and physical development layer(s).

The term "associated" is used in the present specification and claims with reference to the arrangement of the negative emulsion layer, the physical development layer, and the dye forming substance to include any known arrangement of these layers such that one can carry out each of the following operations in the presence of an alkaline processing medium: chemical development in the emulsion layer, physical development in the physical development layer, and the dye formation or release reaction. The most conventional embodiment to this effect consists in placing the emulsion in one layer and the physical development nuclei together with the dye forming substance in another adjacent physical development layer.

In a typical diffusion transfer color photographic element in accord with the present invention, the processing composition, including silver halide solvent and alkaline activator, is introduced between the second transparent support and the negative emulsion layer, after exposure of the latter. The exposed negative emulsion is chemically developed in the presence of a silver halide solvent (by means of, for example, a chemical developing agent incorporated in the emulsion layer) so as to form a silver negative image in the emulsion layer and, simultaneously, a soluble silver complex. This soluble complex diffuses in registration into the adjacent physical development layer where it is physically developed with subsequent formation of dye. The dye thus formed diffuses onto the receiving layer and, consequently, an image corresponding to the unexposed areas in the negative emulsion is obtained, that is, a positive dye image is obtained. To this conventional mechanism of the diffusion of the soluble silver complex is added, in accordance with the present invention, the diffusion of the soluble, reducible silver salt contained in the alkaline activator and the modulation of the diffusion of such soluble, reducible silver salt by the developed negative silver image of the negative emulsion layer. As a consequence, one obtains intensification in areas of maximum density of the positive silver image contained in the physical development layer and of the dye image in the receiver.

In practice, as shown in Example 1 appended hereto, the negative silver halide layer employed in a diffusion transfer color photographic element of the invention also typically has associated therewith an additional component, namely a ballasted scavenger for the oxidized chemical developer formed as a result of the development of the exposed silver halide in the negative emulsion layer. The function of this ballasted scavenger is to prevent the oxidized developer which is formed in the exposed areas of the negative emulsion layer, i.e., negative image areas of the emulsion layer, from migrating or diffusing into negative image areas of the physical development layer, i.e., areas of the physical development layer which correspond to areas of the negative emulsion layer containing exposed silver halide. Such migration of oxidized developer may undesirably lead to the production of diffusible dye (via a cross-oxidation reaction between the oxidized developer and the dye forming substance) in the negative image areas of the physical development layer in addition to the desired production of dye in the positive image areas of the physical development layer. Of course, if the particular oxidized developer formed in the negative emulsion layer is not reactive with the dye forming material present in the adjacent physical development layer, no such ballasted scavenger for oxidized developer is needed.

Where such a ballasted scavenger is employed, this material reacts with the oxidized developer to either immobilize or reduce the oxidized developer. If used, the ballasted scavenger may be located in the negative emulsion layer and/or in an interlayer, such as a gelatin interlayer, present between the negative emulsion layer and the adjacent physical development layer.

Materials useful as scavengers for oxidized developing agent in the present invention may be selected from any of a wide variety of materials which are ballasted, i.e., immobile, and which are capable of reacting with the oxidized developer. The ballast group of the ballasted scavenger, as will be apparent to those skilled in the art, may be any group whose molecular size and configuration is such tht the material to which it is attached is rendered immobile in the colloid layers of the photographic elements of the invention. Typical ballast groups include long-chain alkyl radicals linked directly or indirectly to the scavenger molecule, as well as aromatic radicals of the benzene and naphthalene series, etc., linked directly or indirectly to the scavenger molecule by a removable or irremovable but otherwise nonfunctional linkage depending upon the nature of the scavenger compound. Generally, useful ballast groups have at least 8 carbon atoms.

As used in the present specification, the term "nondiffusing" or "nondiffusible" as applied to various photographically useful materials described herein has the meaning commonly applied to the term in photography and denotes materials which for all practical purposes do not migrate or wander through organic colloid layers, such as gelatin, comprising the sensitive elements of the invention. The same meaning is to be attached to the term "immobile".

The term "diffusible" as used in the present specification as applied to various photographically useful materials described herein has the converse meaning and denotes materials having the property of diffusing effectively through the colloid layers of the sensitive elements in the presence of various nondiffusing materials from which they may be derived. The terms "migrate" and "mobile" have the same meaning.

In practice, a photographic color element of the invention typically includes suitable dye forming substances to achieve formation of three dye images, namely, yellow, magenta and cyan, which, by subtractive color formation, give the final color image. A color photographic unit of the invention therefore comprises three elements arranged in the usual manner, each such element comprising an emulsion layer having the appropriate sensitivity and a physical development layer containing physical development nuclei associated with a dye forming substance. In general, the physical development layer adjacent the blue-sensitive negative emulsion layer is associated with a yellow dye forming substance, the one adjacent the green-sensitive negative emulsion layer with a magenta dye forming substance and the adjacent the red-sensitive negative emulsion layer with a cyan dye forming substance.

The dye image forming substance may be any substance capable of interacting with the oxidation product of a developing agent to form or to release a dye or a dye precursor. Typically, the dye image forming substance associated with the physical development layer is an immobile or nondiffusible substance having linked thereto a splittable dye or dye precursor. The substance is rendered immobile or nondiffusible by the presence of one or more ballast groups of the type well-known in the art, the ballast group by virtue of its molecular size and/or configuration rendering the substance immobile in the photographic element of the invention. The dye or dye precursor upon release from the initially immobile dye providing substance is typically mobile or diffusible and therefore capable of migrating through the various layers of the photographic element to the dye image receiving layer. Various image forming substances useful in the invention are well known and include, for example, the image transfer couplers described in U.S. Pat. Nos. 3,148,062; 3,227,551; 3,227,554 and 3,765,886; the alkalicleavable dye release compounds such as the sulfonamido compounds described in U.S. application Ser. No. 351,673 published Jan. 28, 1975; and other alkali-cleavable dye release compounds such as those described in U.S. Pat. Nos. 3,932,380 and 3,929,760; ring closure compounds such as those described in U.S. Pat. Nos. 3,443,940 and 3,734,726; sulfonyl hydrazones and related compounds such as those described in U.S. Pat. Nos. 3,628,952 and 3,844,785; ballasted dye-releasing hydroquinones and related compounds such as those described in U.S. Pat. Nos. 3,698,897; 3,725,062 and 3,728,113; etc. These substances normally give a negative dye image when they are associated with the development of a negative image in a conventional negative emulsion. However, the use of these dye forming substances in association with the physical development layer(s) used in the elements of the invention makes it possible to obtain a positive dye image from the exposure of a conventional negative emulsion.

In accord with a particularly advantageous embodiment of the invention, sulfonamido compounds, such as the sulfonamidophenols described in U.S. application Ser No. 351,673, published as Trail Voluntary Protest No. B351,673, are used as the dye forming substance. In this case, the mechanism of formation of the color image in the physical development layer may be schematized as follows:

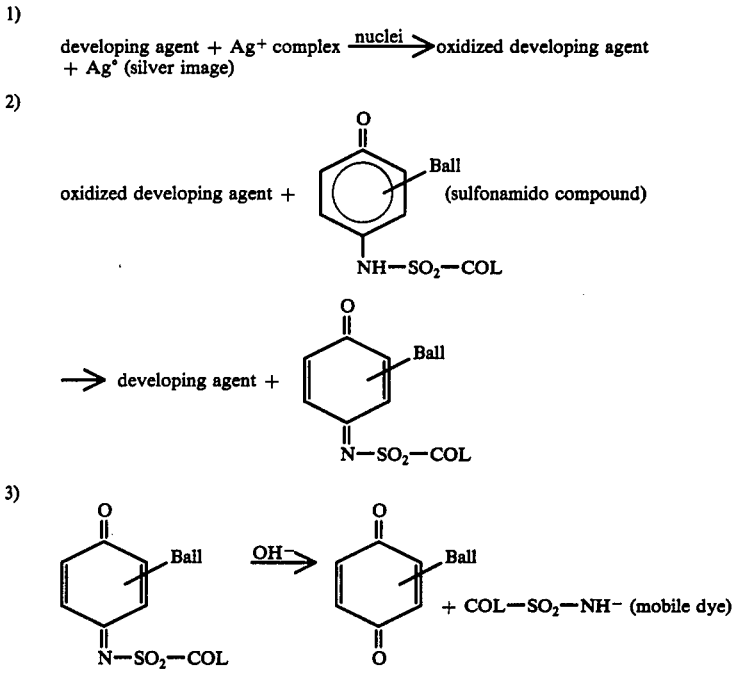

wherein COL represents a dye radical and Ball a radical whose molecular size and configuration is such that the sulfonamidophenol, as also the quinonic residue thereof, are immobile in the colloid layers of the photographic elements of the invention.

In a diffusion transfer color photographic element of the invention wherein the dye forming substances are sulfonamidophenols and wherein the processing composition contains a reducible silver salt, one obtains an increase of the maximum dye image densities without any increase in the minimum dye image densities. Consequently, the modulation of the diffusion of the reducible silver complexes contained in the processing composition in accord with the invention and the resulting increase in the amount of physically developed silver in the areas of the physical development layer having maximum density have direct repercussions on color development. Among other favorable effects also noted in relation to this increase of maximum dye density are, in particular, an improvement of the color saturation and an increase of the dye transfer speed.

With respect to the chemical developers or developing agents used to obtain development in the negative emulsion layer and in the physical development layer of the photographic elements of the invention, useful developing agents may be selected from a variety of such materials well known in the art. For example, in a color photographic element of the invention when the dye forming substance is a color forming coupler, a primary aromatic amine such as a parapheylenediamine or paraaminophenol color developing agent can be chosen for use in association with the physical development layer; when the color forming substance is a sulfonamido compound, a developing agent is chosen which, when oxidized, is capable of undergoing cross-oxidation with this sulfonamido compound in the presence of a silver halide solvent. As will be apparent, in color photographic elements of the invention, the particular chemical developer selected for use in association with the physical development layer is chosen such that the oxidized form of the developer is capable of entering into a dye forming or dye releasing reaction with the particular dye providing substance associated with the physical development layer. Thus, the selection of a particular chemical developer for use in association with the physical developer layer depends in large part on the particular dye-providing substance which is employed.

Among other useful developing agents, the following may be cited:

Hydroquinone,
N-methylaminophenol,
Phenidone: a trade name for 1-phenyl-3-pyrazolidone,
Dimezone: a trade name for 1-phenyl-4,4-dimethyl3-pyrazolidone,
1,2-dihydroxybenzene (catechol)
Aminophenols,
N,N-diethyl-p-phenylenediamine,
3-methyl-N,N-diethyl-p-phenylenediamine,
3-methoxy-N-ethyl-ethoxy-p-phenylenediamine,
4hydroxymethyl-4-methyl-1-phenyl-3-pyrazolidone, etc.

As indicated hereinbefore, the developing agent(s) used in the present invention are often incorporated within the photosensitive element. According to one embodiment, a first developing agent is used in the negative emulsion layer, and a second developing agent is used in the adjacent physical development layer. The first developing agent is selected according to its activity to avoid too active compounds that would cause an overdevelopment of the negative layer; the second developing agent is chosen from among the compounds capable of reacting with the dye forming substance, for example, capable of undergoing cross-oxidation with a sulfonamido compound in the presence of the silver halide solvent. In this embodiment of the invention, the first developing agent is advantageously chosen from among the class of para-aminophenols; and, when a sulfonamido dye forming substance is used, the second developing agent is advantageously chosen from among the class of pyrazolidones.

In accord with a particularly advantageous embodiment of the invention, there is provided a photographic element for diffusion transfer color photography as described above in which the means to introduce a preferably viscous alkaline processing solution is a rupturable pod. Cameras designed to use such color photographic film elements include means permitting a rapid access to the developed print and are equipped with members, so that during the extraction of the photographic film element from the camera, after exposure, the pod is crushed and its content is injected inside the film element. The dye image receiving layer of such a film element may be contacted against the element after the exposure of the latter. Then after a predetermined time of contact in the presence of the viscous alkaline processing solution, the dye receiving layer may be separated from the film element. The dye receiving layer may also be a part of the photographic element in a permanent manner, i.e., after obtaining the image on the receiving layer, the latter is not separated from the rest of the film element. In the latter case, the photographic film element is referred to as "integral no-peel-apart". Such no-peel-apart materials are described, for example, in French Pat. Nos. 2,065,875 and 2,099,015.

The attached drawing, the FIGURE represents a preferred embodiment of a diffusion transfer color photographic element of the invention. The element or unit of the FIGURE comprises a transparent support 10, a dye image receiving layer 11, a reflecting opaque layer 12 (permeable to alkaline solutions), a layer 13 of physical development nuclei containing a cyan dye forming substance, a layer 14 of red-sensitive silver halide negative emulsion, a layer 15 of physical development nuclei containing a magenta dye forming substance, a layer 16 of green-sensitive silver halide negative emulsion, a layer 17 of physical development nuclei containing a yellow dye forming substance, a layer 18 of blue-sensitive silver halide negative emulsion and, finally, a transparent support 19.

The layers 20 and 21 are intermediate layers intended to stop the diffusion of undersirable substances.

The member 22 is a pod containing a silver halide solvent and an alkaline processing solution, said solution containing the soluble, reducible silver salt used in the present invention. This pod can be ruptured, which causes the discharge of its content between the support 19 and the emulsion layer 18. It is known that the rupture of this pod is obtained by means of pressure applying rollers with which are fitted in the cameras using this type of photographic element to produce instantaneous access prints.

The receiving layer of the photographic element of the invention contains, in general, any substance capable of mordanting or fixing the transferred dye. According to one embodiment, the receiving layer may contain a polymeric mordant; if the transferred dye comprises acid solubilizing groups, a basic mordant is chosen, e.g. a polymer containing atoms of quaternary nitrogen, such as those disclosed in U.S. Pat. Nos. 2,882,156; 2,484,430; 3,271,147 or 3,271,148. The receiving layer may have a dry thickness of from about 6 microns to about 10 microns, and it may contain various addenda, such as optical brightening agents, or compounds intended to protect the image against ultraviolet light.

The compounds used according to the invention as dye image forming substances may be incorporated in various manners in the photographic elements. They may be dispersed in the hydrophilic colloids used to form the physical development layers such as when the dye forming substances contain solubilizing groups. Of course, the techniques such as those used for incorporating oleophilic couplers in photographic layers can also give good results; for example, the dye forming substances may be dissolved in a high-boiling solvent, such as tricresyl phosphate, then the resulting solution may be dispersed in a hydrophilic colloid of the physical development layer.

The various negative silver halide emulsion layers used, for example, in an integral color photographic element of the invention, may be positioned in the usual sequence; that is, with respect to the exposure side of the element, are first placed the blue-sensitive silver halide emulsion layer, then the green-sensitive layer, and then the red-sensitive layer. If desired, a yellow dye layer or a Carey Lea silver emulsion layer may be disposed between the blue-sensitive emulsion layer and the green-sensitive layer to absorb or filter blue light radiation that might be transmitted through the blue sensitive emulsion layer. However, if desired, the selectively sensitized emulsions may be disposed in a different order; for example, with respect to the exposure side, first the blue sensitive layer, then the red sensitive layer, and then the green sensitive layer.

The rupturable pod used according to the invention may be of the type described in U.S. Pat. Nos. 2,543,181; 2,643,886; 2,563,732; 2,723,051; 3,056,491 and 3,152,515. Generally, such pods are composed of a rectangular sheet of a material impervious to air and fluids, such rectangular sheet material being folded longitudinally on itself so as to form two walls which are sealed to each other along their longitudinal and lateral edges. A container is thus formed to contain the processing solution.

In general, the silver halide emulsion layers of the photographic elements of the invention are composed of photosensitive silver halides dispersed in gelatin and their dry thickness is between about 0.6 micron and about 6 microns. The dye image forming substances used in the invention are dispersed in polymeric, aqueous alkaline permeable, binder layers, such as gelatin, the dry thickness of such layers being from about 1 micron to about 7 microns. The intermediate layers of polymers permeable to alkaline solutions, e.g. gelatin layers, have a dry thickness of from about 1 micron to about 5 microns. Of course, the values given for the thickness of the layers are approximate and can be modified according to the particular photographic element desired.

The stability of the transferred dye image may be increased by associating a neutralizing substance with the dye image receiving layer. In general, this neutralizing substance makes it possible to reduce the pH of the image layer from an initial value of 13 to 14 to at least a value of 11 and, preferably, to a value between about 5 and about 8. This reduction in pH occurs in a short time after the impregnation of the processing composition into the photographic elements of the invention. For example, acid polymers may be used such as described in French Pat. No. 1,380,778 or metallic salts, e.g. zinc acetate, zinc sulfate, magnesium acetate, or zinc, aluminum, iron, manganese, cobalt or nickel formates, acetates, propionates, stearates or sulfates, etc.; acids in a solid form may also be used, such as described in U.S. Pat. No. 2,584,030. Such neutralizing substances reduce the pH within the photographic element of the invention following the development process so as to terminate this development and to substantially reduce any transfer of dye after this development, thus permitting stabilization of the dye image.

A timing layer or spacer layer may also be used which is placed over the pH reducing layer to "time" or control the pH reduction of the photographic element as a function of the speed with which the alkali diffuses through this inert spacer layer. Examples of such timing layers comprise gelatin, polyvinyl alcohol, or any of the substances mentioned in U.S. Pat. No. 3,455,686. The timing layer is also effective in evening out the various reaction rates over a wide range of temperatures, e.g., premature pH reduction is prevented when imbitition is effected at temperatures above room temperature, for example, at 35° to 38° C. The timing layer is usually about 2.5 to about 18 microns in dry thickness. Especially good results are obtained when the timing layer comprides a hydrolyzable polymer or a mixture of such polymers which are slowly hydrolyzed by the processing composition. Examples of such hydrolyzable polymers include polyvinly alcohol, polyvinyl acetate, polyamides, polyvinyl ethers, partial acetals of polyvinyl alcohol, etc.

The processing composition employed in this invention contains, in addition to the silver halide solvent and the soluble, reducible silver salt, a conventional aqueous solution of an alkaline material, e.g., sodium hydroxide, sodium carbonate or an amine such as diethylamine, preferably possessing a pH in excess of 12. Preferably the processing composition also contains a viscosity-increasing agent such as a soluble, high molecular weight polymer, e.g., a cellulose derivative soluble in water and inert in regard to alkaline solutions such as hydroxyethylcellulose or the salts of alkali metal and carboxymethylcellulose, e.g. sodium carboxymethylcellulose. An amount of viscosity-increasing agent representing from about 1% to about 5% by weight of the processing composition is preferred and such amounts impart the processing composition a viscosity of about 100 cps. to about 200,000 cps. In some cases, an opacifying agent, shch as titanium dioxide ($Ti\ O_2$) or carbon black, may be added to the processing composition.

The alkaline processing composition used for practicing the present invention can be used in a rupturable pod as indicated above, but other techniques may be used for applying the processing compositions; for example the photosensitive element may be dipped in a processing solution or the processing composition may be injected by means similar to hypodermic syringes that are fastened either to a camera or to a camera cartridge containing a photosensitive film element of the invention.

The transparent supports of the photographic elements according to the invention may consist of any substance, provided that this substance does not alter the photographic properties of the film element and provided further that these substances make it possible to obtain supports having good dimensional stability. Typical flexible, transparent sheet support materials include cellulose nitrate films, polystyrene films, poly(ethylene terephthalate), polycarbonate, poly-alpha-olefin films, e.g. polyethylene or polypropylene, as also the films made of other resinous substances as well as glass. The dry thickness of the supports is generally between about 50 microns and about 150 microns.

While the invention has been described with reference to layers of silver halide emulsions and dye image-providing materials, dotwise coating, such as would be obtained using a gravure printing technique, could also be employed. In this techinque, small dots of blue, green and red-sensitive emulsions have associated therewith, respectively, dots of yellow, magenta and cyan color-providing substances. After development, the transferred dyes would tend to fuse together into a continuous tone.

The following examples illustrate the invention.

EXAMPLE 1

A photographic element having the following structure was prepared:

1. a blue-sensitive silver bromoiodide emulsion comprising per $dm^2$, 10 mg of silver, 29 mg of di-octylhydroquinone (ballasted scavenger for oxidized developing agent), 25 mg of gelatin and 0.5 mg of a developing agent; this developing agent is p-methylainophenol sulfate, known also under the trade name Elon;

2. a layer comprising per dm², 0.15 mg of cadmium sulfide nuclei, 15 mg of gelatin, 0.3 mg of a black and white developing agent, 4,4-dimethyl-n-phenylpyrazolidone, known also under the trade name Dimezone and, 16 mg of the sulfonamido compound of formula I hereunder.

3. an intermediate layer comprising, per dm², 1 mg of colloidal silver (Carey Lea silver), 16.5 mg of di-octylhydroquinone and 10 mg of gelatin;

4. a green-sensitive bromoiodide emulsion layer comprising per dm², 10 mg of silver, 29 mg of di-octylhydroquinone, 0.5 mg of Elon and 25 mg of gelatin;

5. a layer comprising per dm², 0.15 mg of cadmium sulfide nuclei, 15 mg of gelatin, 0.3 mg of Dimezone developer and 16 mg of the sulfonamido compound of formula II hereunder;

6. an intermediate layer the composition of which is identical with that of the layer No. 3;

7. a red-sensitive silver bromoiodide emulsion layer comprising per dm², 10 mg of silver, 25 mg of gelatin, 0.5 mg of Elon and 25 mg of di-octylhydroquinone;

8. a layer comprising per dm², 0.15 mg of cadmium sulfide nuclei, 15 mg of gelatin, 0.3 mg of Dimezone and 16 mg of the sulfonamindo compound of formula III hereunder;

9. reflecting layer containing per dm², 215 mg of titanium dioxide and 25 mg of gelatin;

10. image receiving layer comprising per dm², 10 mg of gelatin and 20 mg of a copolymer of styrene and N-benzyl-N-N-dimethyl-N(β-maleimidopropyl)ammonium chloride;

11. cellulose triacetate transparent base.

The emulsions used in layers NO. 1,4 and 7 were sulfur and gold chemically sensitized silver bromoiodide emulsions, the photographic sensitivity of which was about 20 ASA.

Samples of this element were exposed from the layer No. 1 side of the element through a colored density scale, so as to record the response of the element respectively to an exposure to blue light, to green light and to red light.

After exposure, there was applied on the layer No. 1 side of the element, a processing composition A having the following compositions:

| | |
|---|---|
| Potassium hydroxide | 80 g |
| Bis-(methylsulfonyl)methane | 15 g |
| Hydroxyethylcellulose | 20 g |
| Water to make | 1 liter |

The characteristics of the transferred images are shown in Table I below. This is a control experiment.

A second sample of the exposed element was processed with the following composition B:

| | |
|---|---|
| Potassium hydroxide | 80 g |
| Bis-(methylsulfonyl)methane | 15 g |
| $AgNO_3$ | 5 g |
| Hydroxyethylcellulose | 20 g |
| Water to make | 1 liter |

The results obtained are shown in Table I below.

TABLE I

| | Densities in blue light | | Densities in green light | | Densities in red light | |
|---|---|---|---|---|---|---|
| | min | max | min | max | min | max |
| Processing composition A | 0.28 | 2.10 | 0.42 | 2.02 | 0.36 | 2.06 |
| Processing composition B | 0.30 | 2.68 | 0.44 | 2.38 | 0.38 | 2.26 |

EXAMPLE 2

The object of this example is to show the improvement of the color saturation obtained with a photographic element according to the invention.

An element identical with that of example 1 was prepared. It was exposed through a sensitometric scale so as to form a latent image in two emulsions only, e.g. the red-sensitive emulsion and the green-sensitive emulsion; for that, a Kodak Wratten filter No. 15 was used. The element was developed by using activators A and B as described in Example 1. It was found that with the control activator the strongly exposed areas show a density reduction. However, in a sample element processed with the activator B. the yellow dye forming components of the element provided practically the same density in areas corresponding to both the exposed and unexposed areas of the blue-sensitive emulsion.

The results obtained are shown in the following table.

TABLE II

| | Densities in blue light | | Densities in green light | | Densities in red light | |
|---|---|---|---|---|---|---|
| | min | max | min | max | min | max |
| Processing composition A | 1.28 | 2.42 | 0.42 | 2.02 | 0.22 | 1.95 |
| Processing composition B | 2.30 | 2.58 | 0.44 | 2.38 | 0.26 | 2.26 |

EXAMPLE 3

The object of this example is to show the increase of the speed of transfer of the dyes obtained by using a processing composition containing a reducible silver salt in accord with the invention. Samples of an element identical with that of Example 1 were prepared. After exposure, some of these samples were processed, respectively, with processing compositions A and B of Example 1 and densities obtained after various transfer times were noted.

The results obtained are shown in the following table.

TABLE III

| | Processing composition A | | | Processing composition B | | |
|---|---|---|---|---|---|---|
| Transfer time | Dmax blue | Dmax green | Dmax red | Dmax blue | Dmax green | Dmax red |
| 1 minute | 0.25 | 0.30 | 0.40 | 0.25 | 0.30 | 0.40 |
| 2 minutes | 0.92 | 1.10 | 1.59 | 1.30 | 1.15 | 1.75 |
| 3 minutes | 1.15 | 1.30 | 1.70 | 1.80 | 1.54 | 1.82 |
| 4 minutes | 1.38 | 1.57 | 1.85 | 1.98 | 1.68 | 1.90 |
| 5 minutes | 1.55 | 1.72 | 1.88 | 2.10 | 1.80 | 1.92 |
| 8 minutes | 1.75 | 1.92 | 1.90 | 2.40 | 1.95 | 1.95 |

The sulfonamido compounds used in Examples 1-3 have the following formulas:

Formula of compound I.

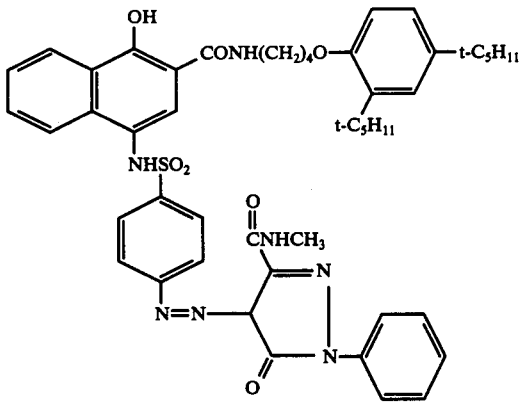

Formula of compound II.

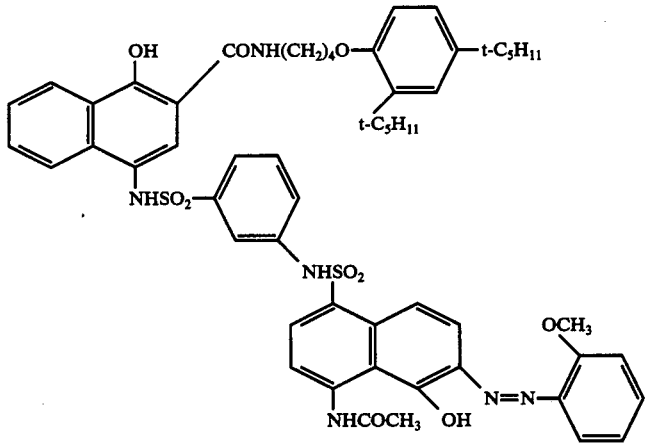

Formula of compound III.

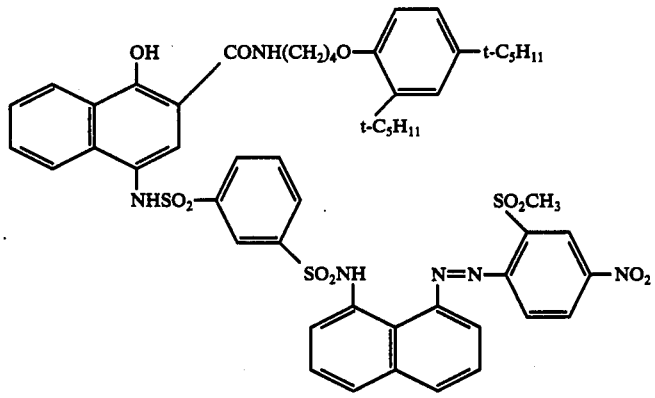

The invention has been described in detail with particular reference to certain preferred embodiments thereof, but it will be understood that variations and modifications can be effected within the spirit and scope of the invention.

I claim:

1. A photographic diffusion transfer process for producing an image in a photographic element, said element comprising 1. a support bearing at least one negative silver halide emulsion layer and a physical development associated with said negative silver halide emulsion layer, said process comprising a. image-wise exposing said negative emulsion layer and b. developing said negative emulsion layer with a chemical developer in the presence of a silver halide solvent and an alkaline activator which contains therein a soluble, reducible silver salt, said development performed such that the silver halide solvent and alkaline activator first contacts said negative emulsion layer and then contacts said physical development layer, whereby physical development of a positive silver image corresponding to the unexposed areas of said negative emulsion layer is produced in said physical development layer.

2. A photographic process as defined in claim 1 wherein said alkaline activator and said silver halide solvent are contained in a single processing composition which is applied to said negative emulsion layer to effect said developing step (b).

3. A photographic process as defined in claim 1 wherein said silver halide solvent is an alkali metal or ammonium thiosulfate, an alkali metal or ammonium thiocyanate, or mixture thereof.

4. A photographic process as defined in claim 1 wherein said silver halide solvent is a bis-(alkylsulfonyl) methane.

5. A photographic process as defined in claim 1 wherein said soluble, reducible silver salt contained in said alkaline activator is silver nitrate.

6. A photographic diffusion transfer process for producing an image in a photographic element, said element comprising 1. a support bearing
   a. a negative silver halide emulsion layer having associated therewith a chemical developing agent and
   b. a physical development layer containing physical development nuclei and associated therewith a chemical developing agent, said physical development layer located between said support and said negative emulsion layer, and
2. means for applying a liquid processing composition containing a silver halide solvent and an alkaline activator comprising a soluble, reducible silver salt to the surface of said emulsion layer opposite said physical development layer, said process comprising
   a. image-wise exposing said negative emulsion layer,
   b. applying said liquid processing composition to said emulsion layer to develop the exposed areas thereof, to solublize said silver halide in the unexposed areas, and to obtain diffusion of such solubilized silver halide and at least a portion of said alkaline activator containing said soluble, reducible silver salt into said physical development layer, and
   c. physically developing the solubilized silver halide and said soluble, reducible silver salt which have diffused into said physical development layer to obtain a positive silver image corresponding to the unexposed areas of said negative layer.

7. A process according to claim 6 wherein said silver halide solvent is an alkali metal or ammonium thiosulfate, an alkali metal or ammonium thiocyanate, or mixture thereof.

8. A process according to claim 6 wherein said silver halide solvent is a bis-(alkylsulfonyl) methane.

9. A process according to claim 6 wherein said soluble, reducible silver salt contained in said alkaline activator is silver nitrate.

10. A photographic diffusion transfer process for producing a dye image in a photographic film unit, said unit comprising 1. a support bearing at least one element comprising
   a. a negative silver halide emulsion layer having associated therewith a chemical developing agent and a ballasted scavenger for oxidized chemical developing agent and
   b. a physical development layer containing physical development nuclei and associated therewith a chemical developing agent and an immoblized dye providing substance which produces a diffusible dye or dye precursor in the presence of alkali and oxidized chemical developing agent, said physical development layer located between said support and said negative emulsion layer, and
2. means for applying a liquid processing composition containing a silver halide solvent and an alkaline activator comprising a soluble, reducible silver salt to the surface of said emulsion layer opposite said physical development layer, said process comprising a. image-wise exposing said negative emulsion layer,
   b. applying said liquid processing composition to said emulsion layer to develop the exposed areas thereof, to solubilize said silver halide in the unexposed areas, and to obtain diffusion of such solubilized silver halide and at least a portion of said alkaline activator containing said soluble, reducible silver salt into said physical development layer,
   c. physically developing the solubilized silver halide and said soluble, reducible silver salt which have diffused into said physical development layer to obtain a positive image of silver and oxidized chemical developer corresponding to the unexposed areas of said negative emulsion layer, and
   d. treating said immobilized dye providing substance with said oxidized chemical developer produced in step (c) to obtain formation and transfer of said diffusible dye or dye precursor in said positive image areas.

11. A photographic diffusion transfer element comprising 1. a support having
   a. a negative silver halide emulsion layer having associated therewith a chemical developing agent and
   b. a physical development layer containing physical development nuclei and having associated therewith a chemical developing agent, said physical development layer located between said support and said negative emulsion layer, and
2. a silver halide solvent and an alkaline activator comprising a soluble, reducible silver salt and means for applying said solvent and said activator to the surface of said emulsion layer opposite said physical development layer.

12. A photographic element according to claim 11 wherein said alkaline activator and said silver halide solvent are contained in a single processing composition incorporated within a rupturable pod overlying said negative silver halide emulsion layer.

13. A photographic element as defined in claim 11 wherein said silver halide solvent is an alkali metal or ammonium thiosulfate, an alkali metal or ammonium thiocyanate, or mixture thereof.

14. A photographic element as defined in claim 11 wherein said silver halide solvent is a bis-(alkylsulfonyl) methane.

15. A photographic element as defined in claim 11 wherein said soluble, reducible silver salt contained in said alkaline activator is silver nitrate.

16. A photographic diffusion transfer element comprising 1. a support bearing
   a. a negative silver halide emulsion layer having associated therewith a chemical development agent and b. a physical development layer containing physical development nuclei and associated therewith a chemical development agent, said physical development layer located between said support and said negative emulsion layer and 2. means overlying said negative emulsion layer comprising a rupturable pod containing a liquid processing composition comprising a silver halide solvent and an alkaline activator containing a soluble, reducible silver salt.

17. A photographic element in accord with claim 16 wherein said soluble, reducible silver salt contained in said alkaline activator is silver nitrate.

18. A photographic diffusion transfer film unit, said unit comprising 1. a support bearing at least one element comprising
   a. a negative silver halide emulsion layer having associated therewith a chemical developing agent and a ballasted scavenger for oxidized chemical developing agent and
   b. a physical development layer containing physical development nuclei and associated therewith a chemical developing agent and an immobilized dye providing substance which produces a diffusible dye or dye precursor in the presence of alkali and oxidized chemical developing agent, said physical development layer located between said support and said negative emulsion layer, and
2. a liquid processing composition containing a silver halide solvent and an alkaline activator comprising a soluble, reducible silver salt and means for applying said processing composition to the surface of the emulsion layer of said element which is opposite said physical development layer.

19. A photographic diffusion transfer film unit according to claim 18 wherein said film unit comprises three of said elements, each of said three elements containing a negative silver halide emulsion layer sensitive to a different area of the visible spectrum and each of said elements containing an immobilized dye providing substance in said physical development layers thereof, the immobilized dye providing substance contained in each of said layers containing a dye or dye precursor having a different color.

20. A photographic diffusion transfer film unit according to claim 18 wherein said soluble, reducible silver salt contained in said processing composition is silver nitrate and wherein said immobilized dye providing substance is a sulfonamido-containing compound.

21. A photographic diffusion transfer film unit for producing a multicolor dye image, said unit comprising a support bearing a dye image receiving layer, a reflecting layer, a red, green and blue light sensitive elements capable of producing cyan, magenta, and yellow dye images in response to red, green, and blue light radiation, respectively, and overlying said three light sensitive elements a rupturable pod containing a liquid processing composition comprising a silver halide solvent and an alkaline activator comprising a soluble, reducible silver salt, 1. said red light sensitive element comprising
   a. a negative silver halide emulsion layer sensitive to red light and associated with said emulsion layer a chemical developing agent and a ballasted scavenger for oxidized chemical developing agent and
   b. a physical development layer containing physical development muclei and associated therewith a chemical developing agent and an immobilized cyan dye providing substance which produces a mobile cyan dye or mobile cyan dye precursor in the presence of alkali and oxidized chemical developing agent, said physical development layer located between said support and said negative emulsion layer sensitive to red light,
2. said green light sensitive element comprising
   a. a negative silver halide emulsion layer sensitive to green light and having associated therewith a chemical developing agent and a ballasted scavenger for oxidized chemical developing agent and
   b. a physical development layer containing physical development nuclei and associated therewith a chemical developing agent and an immobilized magenta dye providing substance which produces a mobile magenta dye or mobile magenta dye precursor in the presence of alkali and oxidized chemical developing agent, said physical development layer for said green light sensitive element located between said support and said negative emulsion layer sensitive to green light, and
3. said blue light sensitive element comprising
   a. negative silver halide emulsion layer sensitive to blue light and having associated therewith a chemical developing agent and a ballasted scavenger for oxidized chemical developing agent and
   b. a physical development layer containing physical development nuclei and associated therewith a chemical developing agent and an immobilized yellow dye providing substance which produces a mobile yellow dye or mobile yellow dye precursor in the presence of alkali and oxidized chemical developing agent, said physical development layer for said blue light sensitive element located between said support and said negative emulsion layer sensitive to blue light.

22. A photographic diffusion transfer film unit for producing a multicolor dye image in accordance with claim 21 wherein said soluble, reducible silver salt contained in said processing composition is silver nitrate.

23. A photographic diffusion transfer film unit for producing a multicolor dye image in accordance with claim 21 wherein each of said cyan, magenta and yellow immobilized dye providing substances contain a sulfonamido group.

24. A photographic diffusion transfer film unit for producing a multicolor dye image in accordance with claim 21 wherein said unit includes a cover sheet overlying said rupturable pod, said cover sheet comprising a neutralizing layer capable of reducing the pH of the resultant film unit subsequent to diffusion therethrough by said alkaline activator and a timing layer associated with said neutralizing layer to control the pH reduction of the film unit.

* * * * *

UNITED STATES PATENT AND TRADEMARK OFFICE

CERTIFICATE OF CORRECTION

PATENT NO. : 4,047,952

DATED : September 13, 1977

INVENTOR(S) : Maurice Edgar Pfaff

It is certified that error appears in the above-identified patent and that said Letters Patent are hereby corrected as shown below:

Column 1, line 39, "embodying the" should read --embodying this--.

Column 1, line 65, "photograpic" should read --photographic--.

Column 2, line 19, before "preferred", --a-- should be inserted.

Column 3, line 21, "it" should read --is--.

Column 4, line 46, " $\geq$ " should read -- $>$ --.

Column 6, line 29, "tht" should read --that--.

Column 6, line 54, "nondiffusing" should read -- "nondiffusing" --.

Column 7, line 4, before "adjacent", --one-- should be inserted.

Column 7, line 53, "alkalicleavable" should read --alkali-cleavable--.

Column 7, line 55, "351,673" should read --B351,673--.

Column 8, line 8, "Trail" should read --Trial--.

UNITED STATES PATENT AND TRADEMARK OFFICE

CERTIFICATE OF CORRECTION

PATENT NO. : 4,047,952

DATED : September 13, 1977

INVENTOR(S) : Maurice Edgar Pfaff

It is certified that error appears in the above-identified patent and that said Letters Patent are hereby corrected as shown below:

Column 8, after line 12, in 2), the structure after "oxidized developing agent +", O
"  should read  OH
"

Column 9, line 26, that part of the formula reading "dimethyl3" should read --dimethyl-3--.

Column 9, line 33, that part of the formula reading "4hydroxymethyl" should read --4-hydroxymethyl--.

Column 10, line 27, "undersirable" should read --undesirable--.

Column 12, line 56, "techinque" should read --technique--.

Column 13, line 3, "p-methylainophenol" should read --p-methylaminophenol--.

Column 13, line 30, "sulfonamindo" should read --sulfonamido--.

Column 13, line 40, "NO. 1,4" should read --No. 1, 4--.

Column 13, line 52, "compositions:" should read --composition:--.

Column 14, line 26, "B." should read --B,--.

Column 15, line 63, after "development", --layer comprising physical development nuclei-- should be inserted.

UNITED STATES PATENT AND TRADEMARK OFFICE

CERTIFICATE OF CORRECTION

PATENT NO. : 4,047,952

DATED : September 13, 1977

INVENTOR(S) : Maurice Edgar Pfaff

It is certified that error appears in the above-identified patent and that said Letters Patent are hereby corrected as shown below:

Column 17, line 35, "solublize" should read --solubilize--.

Column 17, line 46, before "layer.", -- emulsion-- should be inserted.

Column 20, line 5, "muclei" should read --nuclei--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*